US005829176A

United States Patent [19]

Gruneisen, III

[11] Patent Number: 5,829,176

[45] Date of Patent: Nov. 3, 1998

[54] CARD HOLDER

[76] Inventor: Albert H. Gruneisen, III, 1800 Spring Dr., Louisville, Ky. 40205

[21] Appl. No.: 640,494

[22] Filed: May 1, 1996

[51] Int. Cl.[6] ..... B42F 00/00

[52] U.S. Cl. ..... 40/376; 248/309.2; 248/121; 248/452; 24/67.9

[58] Field of Search ..... 40/376, 377, 388, 40/390, 401, 404, 405, 492, 494, 530, 537, 111, 539, 304; 211/41, 109, 46, 59.1; D20/47, 40, 42, 41, 10, 19, 99; D6/314, 476, 310, 513; 281/33; 402/79; 248/309.2, 176.1, 121, 452; 24/67.3, 67.9, 462, 460

[56] References Cited

U.S. PATENT DOCUMENTS

| | | | |
|---|---|---|---|
| 1,711,070 | 4/1929 | Suydam, Jr. | 40/536 |
| 1,927,635 | 9/1933 | Garfunkel | 248/452 |
| 2,468,987 | 5/1949 | Le Moyne | 211/59.1 X |
| 2,510,244 | 6/1950 | Moltrup | 248/121 X |
| 2,889,937 | 6/1959 | Best | 211/46 |
| 2,945,594 | 7/1960 | Parker | 211/46 |
| 3,476,344 | 11/1969 | Pace | 248/304 X |
| 4,674,637 | 6/1987 | Lovelock et al. | 211/46 |
| 5,535,976 | 7/1996 | Gruneisen, III | 248/452 |

FOREIGN PATENT DOCUMENTS

| | | | |
|---|---|---|---|
| 1077959 | 3/1960 | Germany | 248/176.1 |

*Primary Examiner*—Cassandra H. Davis
*Attorney, Agent, or Firm*—James C. Eaves, Jr.; Middleton & Reutlinger

[57] ABSTRACT

A card holder useable, for example, to sit on a table in a restaurant and display the menu, drink lists, advertising, and the like. The holder has a base, an upstanding portion, and a card receiving head portion. An opening permits cards to be inserted or removed, the geometry of the card receiving head portion making it easier to insert cards than to remove them.

17 Claims, 2 Drawing Sheets

CARD HOLDER

BACKGROUND OF THE INVENTION (a) Field of the Invention

The present invention relates to a card holder or easel-type display stand. The holder is useable, for example, to sit on a table in a restaurant and display the menu, drink lists, advertising, and the like. Other possible uses include displaying cards having product or service directories thereon, fee schedules thereon, photographs thereon, training or how-to information thereon (such as a listing of computer input prompts), or children's book pages thereon. The holder has a base, an upstanding portion, and a card receiving head portion. An opening permits cards to be inserted or removed, the geometry of the card receiving head portion making it easier to insert cards than to remove them.

(b) Description of the Prior Art

U.S. Pat. No. 2,945,594 teaches a chart supporting ring having an inturned end portion 26 and a gap 24, which permits charts to be placed on ring portion 22. U.S. Pat. No. 2,889,937 teaches a display stand.

SUMMARY OF THE INVENTION

The present invention is for a card holder. The holder has a stand having a base, an upward extending support, and a card receiving head portion thereatop. Cards, having a clip slot therethrough are received by the head portion. A outer curved surface permits easy receipt of the cards while an inner vertical surface makes it harder to remove the cards from the head portion.

The card holder base sits on a table, or the like. The cards hang downward. Flat portions of the head portion permit the cards to hang neatly. A person can flip through the cards to look at the information they contain.

The preferred card holder comprises a base having a support extending upward therefrom, the support having a top portion; the card holder further having a head portion attached at the top portion of the support, the head portion being external of the support, the head portion having a generally loop shaped portion terminating in an upturned portion, the upturned portion and the top portion of said support having a card opening therebetween. Even further, the upturned portion and the generally loop shaped portion have a generally transverse transition therebetween, while the upturned portion has a generally rounded portion toward the card opening.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
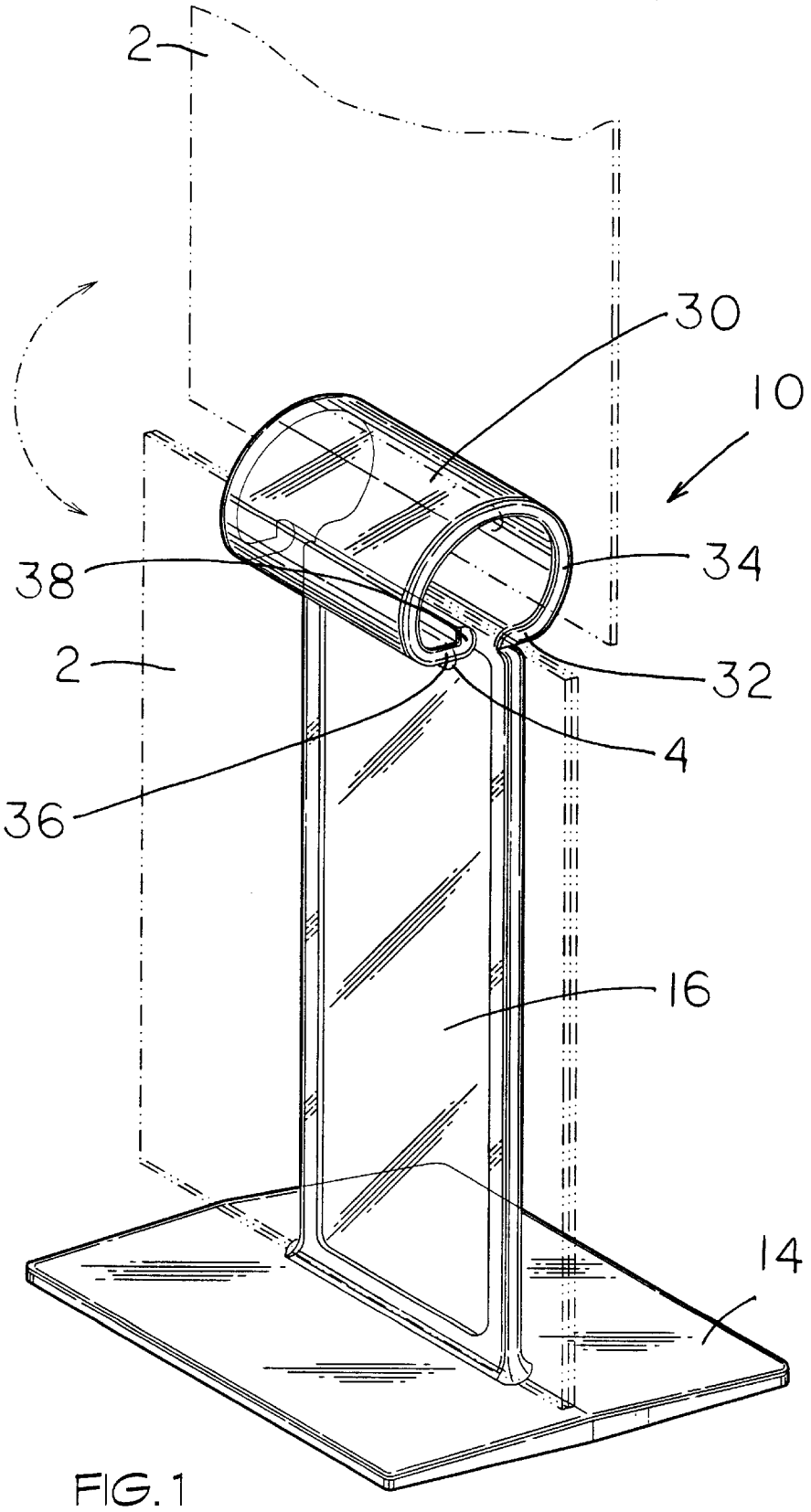
FIG. 1 shows a perspective view of the card holder of the preferred embodiment.
Figure 2:
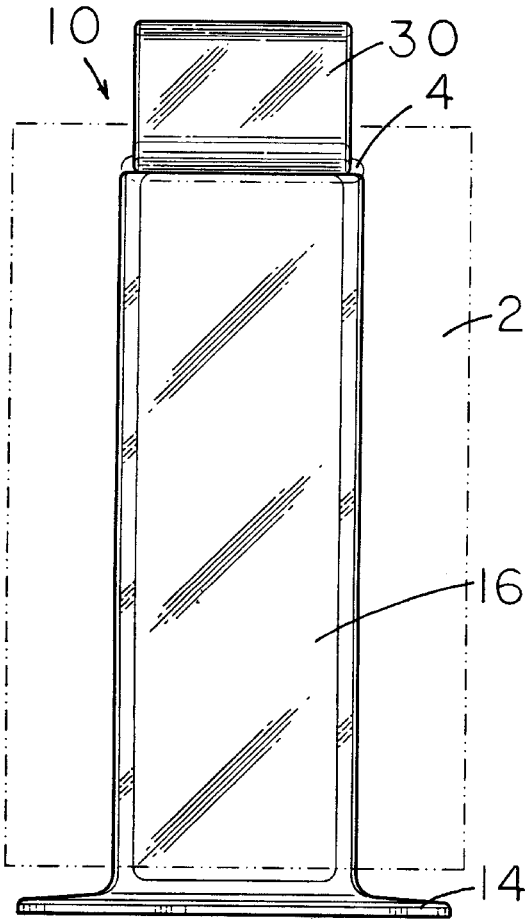
FIG. 2 shows a front view of the card holder of FIG. 1.

With reference to the Figures, the preferred embodiment of the card holder 10 of the present invention is shown having a base 14, an upstanding support 16, and a card receiving head portion 30. Head portion 30 receives at least one card 2 having a card opening or slot 4 therethrough. Cards 2 may, for example, contain advertising, menu lists, drink lists, or related material. Other possible uses include displaying cards 2 having product or service directories thereon, fee schedules thereon, photographs thereon, training or how-to information thereon (such as a listing of computer input prompts), or children's book pages thereon. The cards 2 may be plastic, plastic-coated paper, laminated paper, or the like, as the cards 2 should receive a lot of handling, for example, if used to present a restaurant menu to the customers.

With reference to the Figures, the card holder 10 should be sized so that the cards 2 to be employed with the holder 10 can hang freely from head portion 30 without touching base 14. For example, the lowest portion of head portion 30 could be six or seven inches (15.2 or 17.8 cm respectively) above base 14, holder 10 being, for example eight inches (20.3 cm) in total height. Cards 2 could, for example, be four inches (10.2 cm) wide and six inches (15.2 cm) high, so that, when hanging from head portion 30, they would not touch base 14.

Base 14 can be generally square, rectangular, circular, oval, or any other desired shape. Base 14 would be sized with a sufficient "footprint" to adequately support the holder 10. For example, base 14 could be a square four inches (10.2 cm) on a side. Upstanding support 16 may, for example, have a width of about two inches (5.1 cm).

Holder 10 can be of unitary or two-part construction, for example. Plastic is a preferred material, particularly for ease of cleaning if used in the food and drink industry. As shown, the inventor currently makes the holder 10 of the preferred embodiment as a unitary stand by injection molding, for example. However, many other materials and manufacturing methods can be employed.

Figure 3:
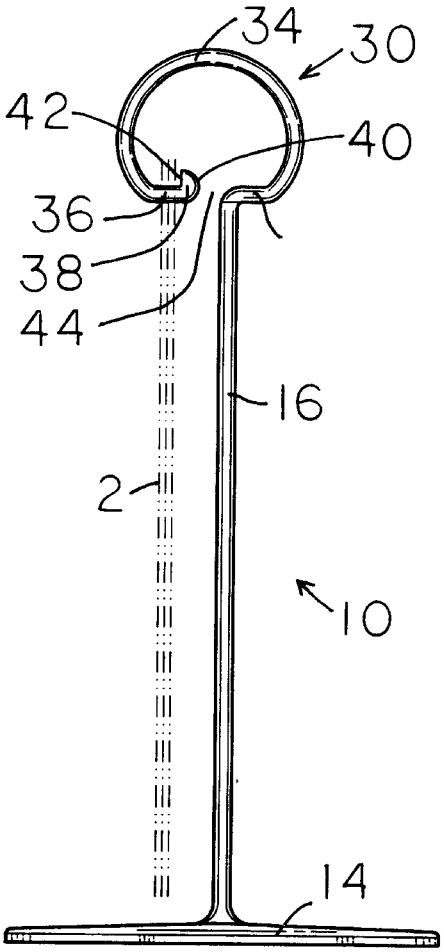
FIG. 3 shows a left side view of the card holder of FIG. 1.
Figure 4:
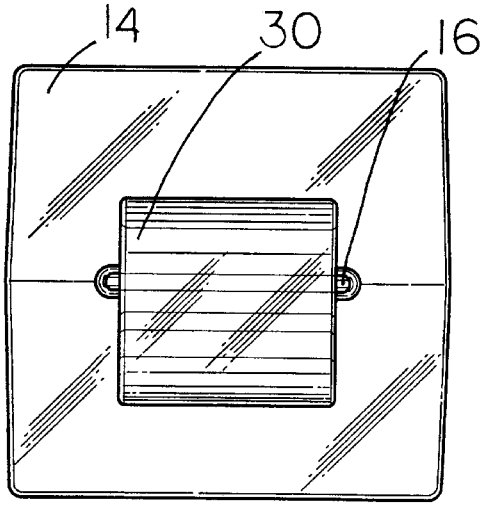
Fig. 4 shows a top view of the card holder of FIG. 1.
Figure 5:
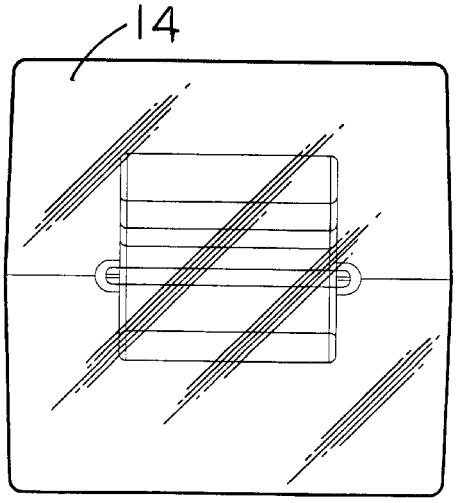
FIG. 5 shows a bottom view of the card holder of FIG. 1.

At the top of upstanding support 16 is card receiving head portion 30, in the preferred embodiment, a changing radius loop. However, a uniform radius loop or other shape could be employed. With reference to the side view of FIG. 3, the loop has an arc of about 340°, leaving a card opening 44 of about 20°. In a horizontal plane, in front and in back of the vertical portion of the upstanding support 16, the loop has horizontally flat portions, first flat portion 32 and second flat portion 36, so that cards 2 placed on the head portion 30 will hang uniformly downward. The open end of the loop has a vertically upturned portion 38. For portion 38, toward second flat portion 36 of the loop, there is transition of ≈90°, as portion 38 has an inner vertical portion 42. Toward the 20° opening, the vertically upturned portion 38 is rounded or tapered, having curved portion 40. Curved portion 40 permits one or more cards 2 to be easily placed onto the head portion 30, but vertical portion 42 makes it harder for the cards 2 to be removed or fall off. Further, as support 16 is external of head portion 30, support 16 does not interfere with the movement of cards 2 by one looking at them.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A card holder, comprising:

(a.) a base, said base having a support extending upward therefrom, said support having a top portion; and, (b.) a head portion, said head portion attached at said top portion of said support, said head portion having a generally loop shaped portion terminating in an upturned portion, said upturned portion and said top portion of said support having a card opening therebetween, said upturned portion and said generally loop shaped portion having a generally transverse transition therebetween, said upturned portion having a generally rounded portion toward said card opening, wherein said upturned portion has a generally semicircular cross-section, said semicircular cross-section having a diameter portion and an arc portion, said diameter portion extending generally vertically upward at said generally transverse transition between said upturned portion and said generally looped shaped portion, said arc portion oriented toward said card opening, whereby said diameter portion and said arc portion are in a cooperative arrangement so that said arc portion aids in placing a card on said card holder and said diameter portion and the generally transverse transition to said generally loop shaped portion aids in retaining said card on said card holder.

2. The card holder of claim 1, said base having a generally square shape and said support having a generally rectangular shape.

3. The card holder of claim 1, said base having a generally square shape and said support having a generally rectangular shape, said base and said support being in a transverse alignment.

4. The card holder of claim 1, further comprising at least one card, said at least one card having a card top and a card bottom, said at least one card having a slot therethrough toward said card top, said upturned portion receiving said slot to retain said at least one card on said head portion, where said support has a first height and said at least one card has a second height, said first height being greater than said second height, where said at least one card hangs freely from said head portion and where said generally rounded portion of said upturned portion toward said card opening eases receipt of said slot by said upturned portion and said generally transverse transition between said upturned portion and said generally loop shaped portion aids in retention of said at least one card on said head portion.

5. The card holder of claim 1, said generally loop shaped portion having at least one flat portion, said flat portion being in a horizontal plane.

6. The card holder of claim 1, where said base, said support, and said head portion are constructed from a plastic material.

7. The card holder of claim 1, where said card holder is of unitary construction.

8. The card holder of claim 1, said generally loop shaped portion having at least one flat portion, said flat portion being in a horizontal plane, the card holder further comprising at least one card, said at least one card having a card top and a card bottom, said at least one card having a slot therethrough toward said card top, said upturned portion receiving said slot to retain said at least one card on said head portion, where said support has a first height and said at least one card has a second height, said first height being greater than said second height, where said at least one card hangs freely from said head portion and where said generally rounded portion of said upturned portion toward said card opening eases receipt of said slot by said upturned portion and said generally transverse transition between said upturned portion and said generally loop shaped portion aids in retention of said at least one card on said head portion.

9. The card holder of claim 8, said base having a generally square shape and said support having a generally rectangular shape.

10. The card holder of claim 9, said base and said support being in a transverse alignment.

11. The card holder of claim 9, where said base, said support, and said head portion are constructed from a plastic material.

12. The card holder of claim 9, where said card holder is of unitary construction.

13. The card holder of claim 1, said generally loop shaped portion having at least two flat portions, said flat portions being in a horizontal plane, the card holder further comprising at least one card, said at least one card having a card top and a card bottom, said at least one card having a slot therethrough toward said card top, said upturned portion receiving said slot to retain said at least one card on said head portion, where said support has a first height and said at least one card has a second height, said first height being greater than said second height, where said at least one card hangs freely from said head portion and where said generally rounded portion of said upturned portion toward said card opening eases receipt of said slot by said upturned portion and said generally transverse transition between said upturned portion and said generally loop shaped portion aids in retention of said at least one card on said head portion.

14. The card holder of claim 13, said base having a generally square shape and said support having a generally rectangular shape.

15. The card holder of claim 14, said base and said support being in a transverse alignment.

16. The card holder of claim 14, where said base, said support, and said head portion are constructed from a plastic material.

17. The card holder of claim 14, where said card holder is of unitary construction.

* * * * *